United States Patent [19]

Breen, deceased et al.

[11] 3,953,962

[45] May 4, 1976

[54] CRIMPED THERMOPLASTIC SYNTHETIC FILAMENTS OF ASYMMETRIC COMPOSITION

[75] Inventors: Alvin L. Breen, deceased, late of Wilmington, Del., by Richard D. Breen, administrator, Kennett Square, Pa.; Herbert G. Lauterbach, Wilmington, Del.

[73] Assignee: E. I. Du Pont de Nemours & Company, Wilmington, Del.

[22] Filed: Dec. 13, 1974

[21] Appl. No.: 532,611

Related U.S. Application Data

[63] Continuation-in-part of Ser. No. 721,403, April 15, 1968, Pat. No. 3,854,177, which is a continuation-in-part of Ser. No. 43,897, July 19, 1960, abandoned, which is a continuation-in-part of Ser. No. 698,103, Nov. 22, 1957, abandoned.

[52] U.S. Cl. ..... 57/140 R

[51] Int. Cl.[2] ..... D02G 3/02

[58] Field of Search ..... 28/1.3, 1.4, 1.6, 72.11, 28/72.12, 72.14, 72.17; 57/140 R

[56] References Cited

UNITED STATES PATENTS

| | | | |
|---|---|---|---|
| 2,931,091 | 4/1960 | Breen | 28/72.17 X |
| 3,143,784 | 8/1964 | Scott | 28/1.4 X |
| 3,156,028 | 11/1964 | Weiss et al. | 28/1.4 X |
| 3,217,386 | 11/1965 | Clendening | 28/1.4 X |

FOREIGN PATENTS OR APPLICATIONS

| | | | |
|---|---|---|---|
| 651,831 | 11/1962 | Canada | 28/72.12 |

*Primary Examiner*—Louis K. Rimrodt

[57] ABSTRACT

Process and apparatus are disclosed for jettexturing yarn of continuous filaments to increase the bulk. Thermoplastic filaments are crimped by forwarding the yarn in a jetted stream of hot compressible fluid, such as heated air or steam onto a moving screen or other foraminous surface and cooling the yarn on the surface prior to imposing any substantial tension on the filaments. Products having especially desirable properties are obtained by treating filaments which develop crimp due to differential shrinkage properties when heat-relaxed, e.g., bicomponent filaments or meltspun filaments which have been quenched asymmetrically by directing cold fluid across the spinneret face.

2 Claims, 6 Drawing Figures

FIG. 1
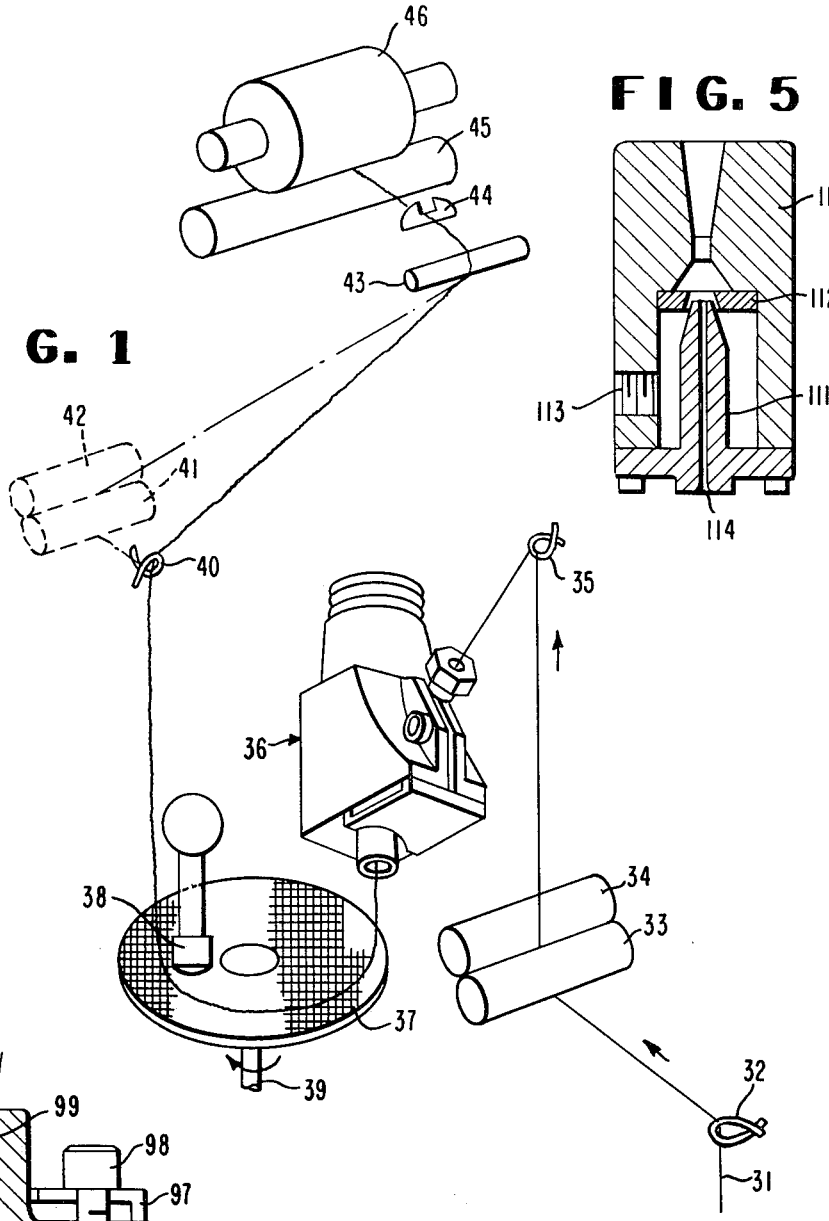
FIG. 5
FIG. 4
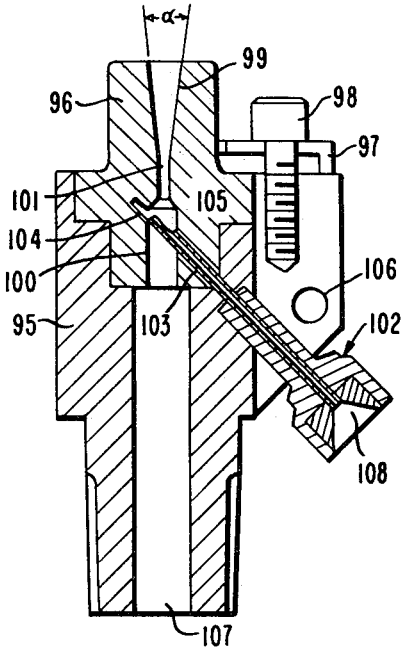

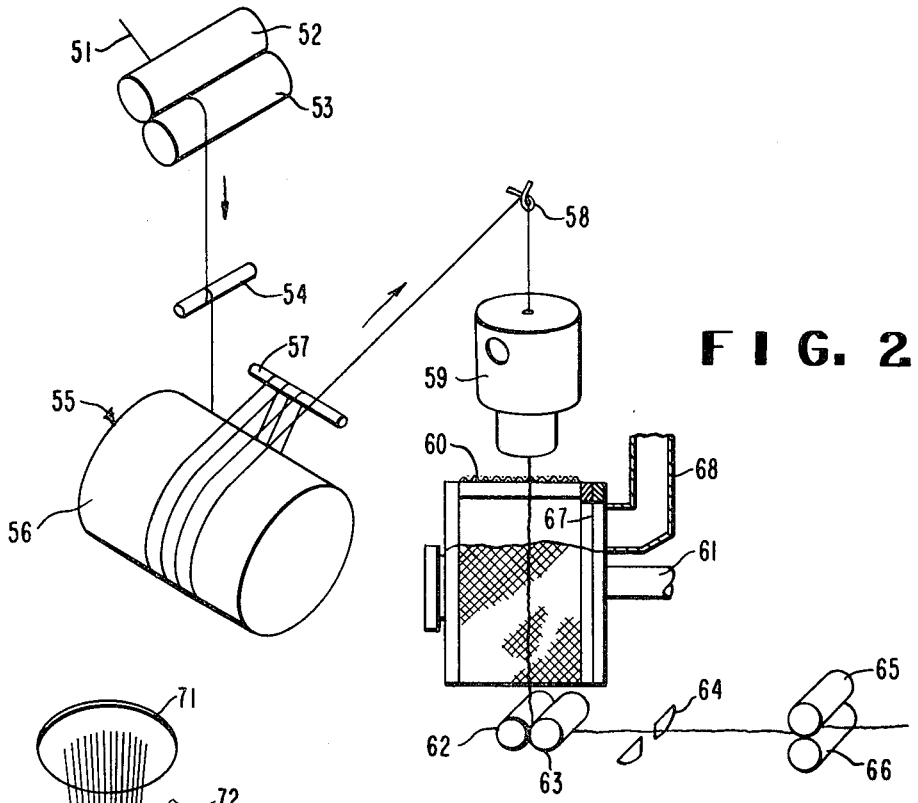
FIG. 2
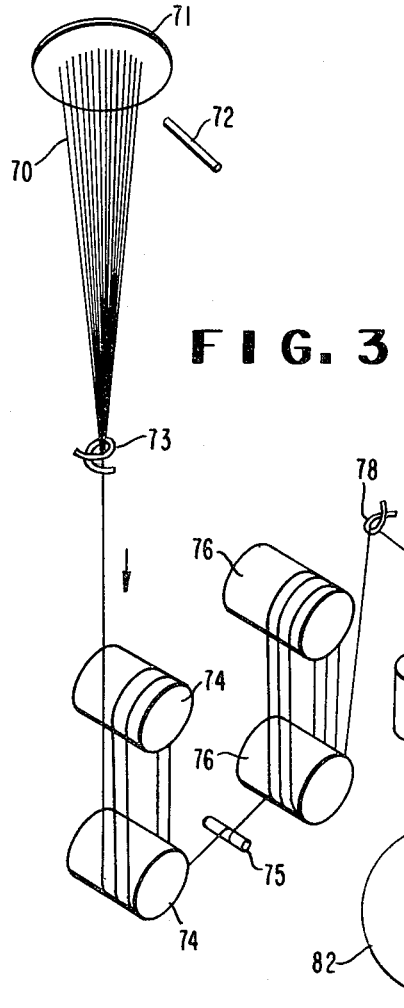
FIG. 3
FIG. 6
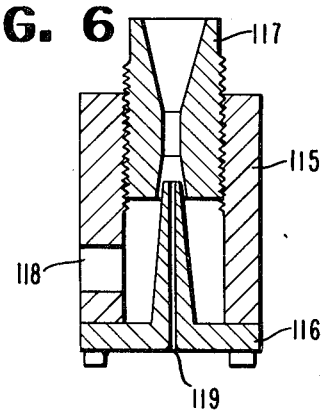

CRIMPED THERMOPLASTIC SYNTHETIC FILAMENTS OF ASYMMETRIC COMPOSITION

REFERENCES TO RELATED APPLICATIONS

This is a continuation-in-part of copending application Ser. No. 721,403 filed Apr. 15, 1968, now U.S. Patent No. 3,854,177 as a continuation-in-part of Ser. No. 43,897 filed July 19, 1960, as a continuation-in-part of Ser. No. 698,103 filed Nov. 22, 1957, both now abandoned.

This invention relates to an improved fluid texturing process and apparatus for producing bulky yarn, tow, or the like, and especially adapted for producing yarn of substantially continuous individually crimped filaments having a random three-dimensional curvilinear configuration and excellent dyeing characteristics.

Artificial fibers are normally produced most easily as continuous filaments. These continuous filament yarns are very strong because of the absence of loose ends that are unable to transmit imposed stresses. Their extreme uniformity and lack of discontinuity, however, makes conventional continuous synthetic filament yarns much more dense than yarns made from synthetic staple fibers. The production of yarn from staple fibers, however, is time consuming and requires a complex series of operations to crimp the fibers, align the fibers into an elongated bundle and then to draw the bundle to successively smaller diameters. The final spinning operation, which involves a high degree of twist, finally binds these discontinuous fibers together to produce a coherent yarn with considerably increased bulk. The occluded air spaces give them a lightness, covering power, and warmth-giving bulk not normally possible with continuous filament yarns. Thus, to get staple fibers that can be processed on conventional wool or cotton spinning equipment, it has been the practice to cut continuous filament yarns such as rayon, acetate, nylon, as well as the polyacrylic and polyester fibers into short lengths for spinning into staple yarn.

It is an object of the present invention therefore to provide an improved process for producing continuous filaments and continuous filament yarn having a bulkiness greater than staple yarn spun from comparable fibers. Another object is to provide an improved process for producing multifilament yarn resembling spun staple in its desirable lightness, covering effectiveness and warmthgiving bulk but retaining the characteristic continuous filament freedom from loose ends, fuzziness and pilling. A further object is to provide such a process for preparing continuous filament yarn having a bulk greater than that of comparable staple yarn without abrading or cutting the constituent filaments. A still further object is to provide such a process which is suitable for economically treating ordinary multifilament continuous yarn at unusually high speeds. Other objects include apparatus for texturing multifilament yarn to provide greater bulk. Other objects will appear as the description of the invention proceeds.

In the process of this invention, yarn comprising plasticizable filaments is textured with compressible fluid heated to a temperature which will plasticize the filaments to impart a persistent crimp having a random, three-dimensional, curvilinear, extensible configuration continuously along the filaments. The process is particularly effective for crimping thermoplastic synthetic linear polymer filaments having differential shrinkage properties which impart crimp when heat relaxed. The heated fluid is jetted as a high velocity stream. The yarn filaments are continuously forwarded by the heated fluid while the filaments are in a plasticized condition, are received on a moving surface to remove the filaments from the heated fluid in a substantially tensionless state, are conveyed on the moving surface for cooling to set the crimp in the filaments, and the cooled filaments are finally taken up from the moving surface for packaging in any conventional manner.

Suitable moving surfaces have multiple perforations or indentations which serve to separate the crimped filaments from the heated fluid. The moving surface for removing the filaments from the heated fluid may be embodied in a drum, disc, belt or similar member having a sieve or screen or slotted surface to receive the filaments. The moving surface is used to convey the filaments away from the heated stream to a separate position where the filaments are removed from the surface.

The crimp developed in the fibrous structure is set on the moving surface before appreciable tension is applied in taking up the structure from the surface. Setting by cooling, or removal of plasticizing solvent can be accomplished by providing a sufficient length and/or time of passage on the moving surface after leaving the heated fluid stream, or with such auxiliary means as a stream of cooling or drying fluid, cooling of the foraminous surface, or otherwise refrigerating or quenching, or evaporating or extracting solvent, to accelerate setting of the crimp.

The process is suitable for producing unusually desirable crimped yarn at exceptionally high speeds. Yarn is readily processed at feed rates of 3000 or more yards per minute. As will be illustrated subsequently in this specification, the process also provides important advantages at the much lower feed rates which have been used previously for bulking yarn. The forwarding action of the texturing stream is adjusted relative to the feed rate to provide for the desired amount of crimping. Pressures of 10 to 500 pounds per square inch gauge (psig.) are generally suitable, depending upon the feed rate and, of course, the nozzle design, material processed, denier per filament and total yarn denier. Feed rates of 12% to 100% greater than the take-up speed of the crimped yarn, after setting on the moving surface, are most useful.

The invention and the manner of carrying it out will be more clearly understood by reference to the drawings, in which, FIG. 1 is a schematic perspective view of apparatus suitable for practicing the process of this invention, FIG. 2 is a schematic perspective view of a variation of this equipment suitable for stretching the yarn and bulking it in successive steps without intermediate packaging, FIG. 3 is a schematic perspective view of similar equipment adapted to spinning, drawing and bulking in successive steps without intermediate handling or packaging, FIGS. 4 through 6 illustrate various jet devices useful in the process of this invention.

In FIG. 1, the moving threadline of yarn to be treated 31 is passed through guide 32, between feed rolls 33 and 34, over guide 35, through fluid jet 36, is received on moving screen 37, and is conveyed through a stream of cooling fluid from nozzle 38 to set the crimp. The moving screen is shown in the form of a horizontal disc supported on a rotating shaft 39. A screen in the form of a moving belt or revolving cylinder can obviously be used instead of the disc shown. Also, the jet can discharge horizontally onto a vertical moving screen, instead of downwardly as shown, or at any other convenient angle. One or both of the feed rolls 33 and 34 can be heated to preplasticize the yarn or any conventional heating means can be used, e.g., by passing the yarn over a heated metal shoe. The treated yarn is subsequently removed from the screen, passing through guide 40 directly to guide 43 or being forwarded by rolls 41 and 42. Traverse guide 44 may be used to distribute the bulky yarn on package 46 driven by roll 45.

FIG. 2 shows undrawn yarn 51 passing continuously between feed rolls 52 and 53 around pin 54 to draw roll 55 having cylindrical surface 56. Several wraps of yarn are placed about surface 56 and idler roll 57. The yarn is then passed continuously through guide 58 to jet 59 and crimp set on screen-surfaced drum 60. The drum is rotated on shaft 61 to carry the bulked yarn away from the jet stream, and the yarn is withdrawn from the drum at a subsequent position in its rotation by take-off rolls 62 and 63. From the take-off rolls the bulky yarn is passed continuously through traverse guide 64 to package 65 driven by roll 66. The screen-surfaced drum is provided with means, including exhaust port 67 and ductwork 68, for removing fluid from within the drum by exhaust apparatus (not shown). This is arranged to withdraw the heated fluid discharged by the jet 59, and to provide a stream of cooling fluid through which the yarn is conveyed prior to removal by the take-off rolls.

In FIG. 3, filaments 70 from spinneret 71, quenched asymmetrically by cold fluid directed to the face of the spinneret by fluid nozzle 72, are converged at guide 73 and passed around a pair of rolls 74. The yarn passes around draw-pin 75 and is continuously drawn by wraps around a pair of rolls 76 moving at higher speed. The yarn is fed through guides 78 and 79 and jet 80, where a jet stream of heated fluid acts to separate, crimp and forward the filaments onto screen-surfaced drum 82. The filaments are conveyed under a stream of cooling fluid from nozzle 83 to set the crimp, and the cooled filaments are then taken off of the screen-surfaced drum around guide roll 84 by rolls 85 and 86 and wound up.

A device for building up tension slowly in the crimped yarn may be interposed between the screen surface drum and rolls 85 and 86. One such device is a series of parallel pins through which the yarn line runs, the yarn wrapping on each pin for less than half its circumference. Another device is an adjustable leaf spring which presses the yarn against a mating surface, the spring pressure being adjustable.

FIG. 4 is a jet suitable for the practice of this invention, consisting of body member 95, orifice member 96, held in place by clamp 97, and screw 98. The passage through orifice member 96 consists of cylindrical opening 100, connecting with concentric cylindrical opening 101, and outwardly tapered opening 99, characterized by the angle $\alpha$. Yarn tube member 102, supporting hollow needle 103, in hole 104, with cutaway section giving a lip 105, is supported in body member 95, in an adjustable fashion by screw tighted in tapped hole 106. The compressible fluid is applied to the nozzle at 107 and the yarn is fed to needle member through hole 108.

FIG. 5 is another jet consisting of body member 110, and yarn guide member 111, with perforated disc 112 and fluid entrance 113. Yarn is fed to this nozzle through opening 114.

FIG. 6 is a similar jet consisting of body member 115, yarn guide 116 and orifice 117. Compressible fluid enters the body member through opening 118 and the yarn enters through opening 119. The nipple of yarn guide 116 extends into the entrance of venturi-shaped orifice 117 and is slightly off-center with respect to the orifice axis.

In the preferred process of this invention, filaments and yarns meeting the stated objects are provided by a process in which a stream of a compressible fluid at a temperature above the second order transition temperature of the polymer of which the filament is made, and preferably at least about 300°F., is vigorously jetted to form a turbulent plasticizing region which will maintain the yarn temperature above the "cold point" as described more fully hereinafter and below the melting point of the yarn. The yarn or other strand of filaments to be treated is positively fed at a rate greater than the yarn take-up speed into the fluid plasticizing stream so that the yarn is supported by it and individual filaments are separated from each other and crimped individually while whipping about in the hot turbulent plasticizing region and are then removed from the fluid stream by a screen or other foraminous surface where they are rapidly cooled while being maintained at low tension to set the convolutions. During the jetting treatment, filament shrinkage occurs because of the heat transmitted to the fibers. The process elements such as temperature, pressure, fluid flow, yarn speed, tension, and windup speed are adjusted so as to give a final yarn denier (measured in relaxed form after hot-wet relaxation) at least 30% greater than the feed yarn denier.

The crimped filaments are conveyed on the screen from the plasticizing zone toward take-up rolls. The filaments are cooled on this screen before reaching the take-up rolls to prevent further plastic flow and to insure retention of the crimp while maintaining the yarn in a substantially relaxed and tensionless condition. After cooling, the yarn may be tensioned to remove any fiber loops, eliminate any packing of filaments and to improve the bulking characteristics of the yarn. Tensioning is desirable also for forming a suitable package on any windup device. Tension applied in taking up the yarn from the screen or in winding the yarn on a package appears to cause some temporary removal of fiber crimp, but this crimp is subsequently recovered when the yarn is relaxed and boiledoff. Stable crunodal loops are avoided or at least kept to a minimum by control of the process conditions since such entangled loops prevent maximum bulk from being obtained in the yarns. The crimped yarn, of course, may be cut into staple after removal from the screen. This process, therefore, provides a highly productive way of crimping tow which is to be used in staple products. This process may also be used for setting dyes in the yarn. A yarn padded with dyes may be either treated with a turbulent fluid to set the dyes in the fiber by diffusion through the fiber or it may be treated with a turbulent fluid to simultaneously bulk the yarn and set the dyes.

All commercial procedures for manufacturing synthetic fibers inadvertently subject a portion of the yarn or certain segments of a portion of the yarn and filaments to plucks or other stresses as, for example, when processing with fluids or passing over guides, which causes these yarns or segments to dye at a different rate and/or to a different depth relative to the bulk of the yarn. The dynamic relaxation employed in this invention eliminates most of the non-uniformities in structure caused by these plucks and stress and thus the treated yarns have much more uniform dyeability along and across the bundle than can be obtained by non-turbulent radiant heating or by contact with heated mechanical surfaces. The yarns prepared by the process of this invention therefore have better dyeing uniformity than bulk yarns prepared by the twist heat-set method, by stuffer-box crimping, or by other processes known in the art.

The products of this invention assume a three-dimensional, non-helical, random, curvilinear configuration. The crimp is permanent to normal fiber processing conditions and will persist in filaments taken from the yarn bundle. On exposure to hot water, marked increases in crimp amplitude and frequency are obtained. The useful products of this invention have a crimp level in excess of 5 per inch, and preferably above 10 per inch. They may even be as high as 70 or 80 crimps per inch.

While the preferred form of material is continuous filaments, the process and resultant improvements occur with staple yarns as well. Both types of materials can be made into bulky yarns and fabrics having improved bulk, covering power (opacity) and hand.

This process is useful for both monofilament and multifilament yarns in textile deniers as well as the heavier carpet and industrial yarn sizes either singly or combined in the form of a heavy tow. Fine count and heavy count staple yarns can be processed both as singles and plied. The process and product are also not restricted in the case of the synthetic materials to any one particular type of filament cross section. Cruciform, Y-shaped, deltashaped, ribbon, and dumbbell and other such filamentary cross sections can be processed at least as well as round filaments and usually contribute still more bulk than is obtained with round filaments.

For good bulking action the heated fluid should be jetted at a velocity of at least ½ sonic velocity. To achieve maximum bulking or crimping it is desirable that the tension of the yarn subject to the jetted fluid medium be maintained below about 0.2 gm./denier. Preferably yarn tension during the bulking is maintained between about 0.0001 and about 0.01 gm./denier. For the most efficient bulking action at the highest degrees of bulk and highest throughput of yarn, tension of the yarn should be maintained between about 0.0005 and about 0.005 gm./denier. This low tension in the yarn is regulated by controlling the yarn feed rate and the degree of forwarding action of the fluid plasticizing medium. This forwarding action depends in part on the distance the yarn travels in the fluid. In high speed operation, it is desirable that the yarn be removed from the jetted stream within 2 inches after issuing from the jet, and preferably within ½ inch of the outlet of the jet orifice.

Yarn feed speed can be varied over a considerable range depending on the material, temperature, denier, degree of bulking, tension and other variables. For economic reasons (productivity/position) the feed rate should be at least 30 ypm although slower speeds may be used for specific items, special effects or very large denier tows. Feed rates can run as high as 3000 ypm and higher.

The temperature of the heating fluid must be high enough so that either alone or in combination with some auxiliary plasticizing component, e.g., water, acetone or other solvent, it will soften or plasticize the filamentary material passing through the heating area. The optimum temperature, of course, varies depending upon the material being treated, the form of the material being treated, i.e., staple or continuous filament, the denier or yarn size, the rate of throughput, the degree of turbulence and/or pressure of the treating fluid, the design of the treating chamber, and the degree of crimping desired. The temperature can range as high as 700°F. or more and a preferred range is 400°–600°F. The controlling factors are the characteristics of the material being treated and the temperature actually reached by the filamentary material during treatment. The yarn temperature during the crimping operation should exceed the second order transition temperature to insure permanence of crimp. The true upper limit, of course, is the temperature at which objectionable melting and/or chemical degradation of a given yarn takes place.

The crimped yarns are cooled after treatment in the hot plasticizing fluid and prior to any further operation that imposes tension on the yarn bundle. This quenching, cooling, or freezing operation locks in the three-dimensional, random, curvilinear configuration imposed on the various filamentary elements by the hot turbulent fluid. This quenching operation should preferably cool the yarn below the second order transition temperature, $T_g$. After cooling, the yarn can be subjected to normal processing tensions and wound into any of the conventional yarn packages. This quenching operation can be carried out after the yarn has been removed from the foraminous surface by piddling into a silver can or onto a moving belt but from an economic viewpoint it is preferred to cool the yarn on this surface, e.g., screen, as an integral element of the over-all crimping or bulking process, if desired, by use of a positive cooling operation as the yarn is conveyed on the foraminous surface to the take-up roll. The important factor is that cooling is effected prior to imposing any substantial tension on the hot plastic crimped filamentary material.

Adequate cooling of the yarn on the foraminous surface can be achieved by passage across a chilled plate or roll. Passage of the yarn through a suitable liquid bath will also cool the yarn adequately. The preferred embodiment, however, is the use of a flow of a cooling fluid, preferably a gas. This can be in the form of a jet that impinges the gas on the yarn bundle. The cooling jet may be at room temperature or even refrigerated.

The yarn feed should be adjusted so that the tension in the processing zone is extremely low as indicated previously. The overfeed rate can be as high as 250% or higher but for most yarns this value is from 10% to 100%, above 30% being preferable for many polymers.

The feed pressure of the hot plasticizing fluid will depend on the degree of turbulence desired, feed speed, yarn denier, material being processed, design of jet and the like. Pressures in the range of 10 psig. to 500 psig. are useful while the preferred range is from 40–100 psig. Normally, economics will dictate that the optimum pressure is the lowest that still gives the desired degree of crimping.

It is preferred that continuous filament feed yarn contain little or no twist. The twist level should be below 2.0 tpi. and preferably below 1.0 tpi. Yarns of higher twist levels can obviously be processed, however, the tendency is for the formation of stable loops and filament intertangling at the expense of bulk and extensibility of the yarn bundle — thus the yarn bundles become increasingly compact as the twist level rises. Obviously, the twist level of the feed yarn must be much higher if staple yarns are processed. The discontinuous nature of the fibers seems to minimize the formation of an objectionable degree of filament looping and yarn bundle compacting.

The process is well adapted for using a number of ends of yarn in the same jet. Thus, it is possible to pass two to five or more ends through a single jet at the same time. The resulting yarn may have the ends well blended or it may have bulked ends which will be distinctly separate and independently windable depending on the processing conditions. Two or more yarns may also be treated using different tensions or feed rates so as to produce a tensionstable bulky yarn with extensibility confined to that of the shorter member. Likewise, two different types of yarn such as nylon and rayon may be passed through the jet. The differential shrinkage and heat-setting of the two types of yarn provides many interesting effects which are desirable for aesthetic reasons in textile materials.

Drawn thermoplastic yarns, particularly polyesters, are often stabilized by heating at constant extension after drawing to minimize the shrinkage which they would undergo during ordinary fabric finishing at temperatures near or slightly above the boiling point. However, even such stabilized yarns may shrink considerably when subjected to temperatures above those used in the initial stabilization and particularly when the heating is accompanied by the multiple flexing and relaxation which the yarn undergoes while whipping about in the hot turbulent jet stream and when deposited on a screen drum. The relative shrinkages of two different yarns may be adjusted by such factors as the conditions under which the yarns were originally drawn and stabilized, the degree of preheating which the yarns receive, and the temperature of the bulking jet fluid.

The process of this invention can produce a gross increase in the bulk of the filamentary structures. The comparison of the starting denier to the final denier is a crude indication of the bulk increase. However, a better measure of bulk can be obtained by determining the volume of a definite weight of yarn while under pressure. This measurement of bulk under compressional loads is useful for estimating the bulk which a yarn will have when fabricated into carpet or other fabrics. It correlates very well, for example, with subjective impressions obtained by feeling a carpet with the fingers. For the purpose of this invention bulk is, therefore, measured under a pressure of 3.1 lbs/sq.in. The crimped yarn samples are measured in the untwisted state, that is, with less than one turn per inch in the gross yarn. Before testing, the untwisted yarn is given a hot wet relaxed treatment to develop maximum bulk and is then dried and conditioned at 70°F. and 65% relative humidity. Weighed samples of exactly 2.0 g. are then cut into ½ to ¼ inch pieces. The cut pieces are then dropped at random into a hollow stainless steel cylinder having an inside diameter of 1.008 inches. A round stainless steel piston of 1.000 inch diameter is then lowered slowly into the cylinder to compress the yarn and finally to exert a pressure of 3.1 lbs./sq.in. on the top of the yarn sample. After maintaining this pressure for 100 seconds, the volume of the compressed yarn is determined. The volume in cubic centimeters divided by the weight of the yarn in grams is the specific volume (cc./g.) This measurement is always made with a load of 3.1 lbs./sq.in. on the yarn. The specific volume of yarn prepared by this process is much greater than the specific volume of yarns prepared by other crimping processes such as stuffer-box crimping, false twist-heat set, or knife-edge crimping. The specific volume of yarns prepared by this process ranges from 7 to 14 cc./g. Yarns from other bulking processes, on the other hand, usually have specific volumes from 3 to 7 cc./g.

The following examples are given by way of illustration and not limitation. It is to be understood that while they illustrate the use of certain synthetic polymeric yarns having certain cross sections these may be substituted by any other polymeric yarn or filament herein disclosed having any cross section such as circular, square, rectangular, flat, star-shaped, or those having three or more cusps and similar shapes. Likewise the denier, speed, temperature, screen speed and other considerations may vary widely within the limits given above.

EXAMPLE I

Yarns of various denier and polymer composition are bulked with the apparatus illustrated in FIG. 1. The yarn is passed over a feed roll at various feed speeds as recorded in Table I just before entering the jet. As the yarn emerges from the jet, it impinges on a moving screen. The screen speed is also shown in Table I. As the yarn moves away from the jet on the moving screen, it is cooled to set the crimp. After the yarn is set adequately it is passed between the take-up rolls and then to a suitable windup.

TABLE I

| Examples | A | B | C | D | E | F |
|---|---|---|---|---|---|---|
| Polymer | 6—6[1] | 6—6[1] | 2GT/S1[2] (.98/.02) | 2GT/S1[2] (.965/.035) | HPXGT[3] | 6 Nylon[4] |
| Denier | 40 | 70 | 70 | 70 | 150 | 2100 |
| No. Filaments | 13 | 34 | 50 | 50 | 34 | 112 |
| Twist | 0.5"X" | 0.5"Z" | 0 | 0 | 0.5"Z" | 0 |
| Luster | Semidull | Semidull | Semidull | Semidull | Semidull | Bright |
| Cross Section | Trilobal | Trilobal | Trilobal | Trilobal | Round | Round |
| Tenacity (g/d) | 4.9 | 6.2 | 3.2 | 2.3 | 3.2 | 8.1 |
| Break Elongation (%) | 44 | 54 | 61 | 26 | 12 | 40 |
| Initial Modulus (g/d) | 14.5 | 14.7 | 44 | — | 51 | 27 |
| Dyeing Rate (%/10 Min.) | 1.05[5] | 1.45[5] | 1.26[6] | 3.36[6] | — | 0.74[5] |
| Long Period (A) | 75 | 80 | 99 | — | — | — |
| Processing Conditions: | | | | | | |
| Feed Speed | 1000 | 566 | 1000 | 1039 | 633 | 200 |
| Steam Temperature (°F.) | 550 | 556 | 500 | 427 | 580 | 435 |

TABLE I-continued

| Examples | A | B | C | D | E | F |
|---|---|---|---|---|---|---|
| Steam Pressure (psig) | 40 | 38 | 50 | 50 | 50 | 40 |
| Screen Speed (ypm) | 40 | 33 | 45 | 33 | 40 | 40 |
| % Overfeed | 33 | 47 | 75 | 34 | 26 | 100 |
| Bulked Yarn (Boiled Off) | | | | | | |
| Bulked Denier (BYD) | 72 | 112 | 170–190 | 113 | 228 | 4700 |
| Tensioned Denier (TYD) | 48 | 80 | 110–120 | 95 | 188 | — |
| Crimp Elongation (YCE) % | 50 | 40 | 25–30 | 18 | 15 | — |
| Crimps Per Inch | 31 | 25 | 18–22 | 13 | 12 | — |
| Tenacity (g/d) | 4.5 | 4.3 | 3.0 | 1.7 | 1.8 | 6.5 |
| Break Elongation (%) | 65 | 70 | 50 | 46 | 38 | 70 |
| Initial Modulus (gpd) | 8.8 | 11.8 | 29 | — | 8.3 | 12 |
| Dyeing Rate (%/10 Min.) | 3.15[5] | 2.57[5] | 3.55[6] | 4.00[6] | — | 2.1[5] |
| Specific Volume (cm.[3]/g.) | 6.5 | 6.5 | 8.5 | 7.4 | — | — |
| Long Period (A) | 89 | 96 | 146 | — | — | — |

[1]6—6 is poly(hexamethylene adipamide)
[2]GT/S1 is a copolymer of poly(ethylene) sulfisophthalate) with the mol fraction of the respective constituents being indicated in parenthesis.
[3]HPXGT is a 66/34 trans/cis mixture of isomers of 1,4-bis (hydroxymethyl) cyclohexane and terephthalic acid.
[4]6-Nylon is poly(epsilon caproamide).
[5]Acid dyeing rate.
[6]Basic dyeing rate.

EXAMPLE II

A fiber of a polymer of acrylonitrile having 93.65% by weight acrylonitrile, 5.98% methylacrylate, and 0.37% styrene sulfonic acid is bulked by discharging onto a moving belt. The feed is 900 denier, 80 filament, 0.3 Z twist, semidull yarn with dogbone-shaped cross section filaments. The yarn is processed using the general conditions described in Example I. The steam temperature in the jet is 510°F. and 75 psig. The yarn passes to the jet at 500 ypm. and impinges on the moving screen as it emerges from the jet. The yarn is carried along on the screen at 30 ypm. for about 24 inches during which it is cooled and crimp set. Then the yarn is continuously removed from the screen and passes over the takeup roll at 305 ypm. Thus, the overfeed is about 61%. Finally, the yarn is collected by piddling. The product is a very bulky yarn having a bulked denier of 1848, a yarn crimp elongation of 48%, a tensioned yarn denier (at 0.1 g/d) of 1248, and having 11 crimps/inch in the filaments. The boiled-off filaments from the bulked yarn had a tenacity of 2.7 g/d, 33% elongation at break, and an initial modulus of 35 g/d. (Feed yarn properties are 3.1 g/d tenacity, 34% elongation, and 33 g/d initial modulus.) Using the cylinder bulk test (as described previously) the yarn bulk before boil-off is 13.2 cc/g and the yarn bulk after boil-off is 10.8 cc/g.

EXAMPLE III

A yarn of poly(ethylene terephthalate) 70 denier/-50 filaments (trilobal) is bulked with the apparatus illustrated in FIG. 1. Processing conditions are 550 ypm. yarn feed speed, 550°F. steam at 50 psig., 45 ypm. screen speed, and 50% total overfeed. The bulked yarn has a tensioned (0.1 gpd.) denier of 117.1, a force to break of 227 g. at a breaking elongation of 76%. Specimens of the feed and the bulked yarn are dyed at 208°F. in a 4% Latyl Blue 4R bath with no carrier. Dye absorption at 120 Min. is 19.3% for the feed yarn and 76.0% for the bulked yarn or about a 295% increase in dye rate as a result of the bulking process.

EXAMPLE IV

A series of yarns are made by bulking with the apparatus of FIG. 1 at various steam temperatures to illustrate the effect of temperature on resulting yarn bulk. The yarn has an initial denier of 70 and contains 50 filaments of trilobal cross section made from a basic-dyeable poly(ethylene terephthalate) copolymer having 2.0 mol per cent of the sodium salt of poly(ethylene sulfisophthalate). The zero twist feed yarn is fed to the jet illustrated in FIG. 5 at 1000 ypm using 50 psig superheated steam at temperatures varying from 500°F. by the deviation shown in the following table. Screen speed is maintained at 45 ypm and windup tension at 7 grams. Bulked yarns of various deniers, strengths, and specific volumes (bulk) are obtained as shown in the following table. The bulk is determined under pressure as described previously.

TABLE II

STEAM TEMPERATURE VS. BULKED YARN PROPERTIES

| Temp. Deviation (°F. from 500°F.) | Bulked Yarn Denier | Break Strength (Gms.) | Bulk (cc/Gm.) |
|---|---|---|---|
| +10 | 130 | 105 | 8.0 |
| + 5 | 124 | 135 | 8.0 |
| 0 | 120 | 160 | 8.5 |
| − 5 | 118 | 175 | 8.5 |
| −10 | 113 | 185 | 9.0 |
| −15 | 109 | 192 | 9.0 |
| −20 | 106 | 200 | 9.5 |
| −25 | 103 | 200 | 9.5 |
| −30 | 99 | 210 | 10.0 |
| Control Yarn | 70 | 235 | 5.5 |

EXAMPLE V

It is possible to bulk yarn at very high rates of yarn feed. For example, feed yarn as described in Example IV, is melt-spun, drawn 4X and bulked in one continuous operation without any intermediate packaging, as illustrated schematically in FIG. 3. The screen consists of a cylinder of 30-mesh brazed stainless steel wire wherein the wire diameter varies from 0.0112 to 0.015 inch. Yarn feed speed is maintained at 2750 ypm., and overfeed is varied from 45% to 100% while steam temperature is varied from 480° to 545°F. at 50 to 75 psig. Screen speed is also varied from 50 to 150 ypm. Bulked yarn specimens are produced with a range of properties resulting from this range of processing conditions. Ranges in yarn properties for these specimens are shown in the following table along with similar data for the unbulked feed yarn.

TABLE III

| Properties of Bulked and Feed Yarns | Feed Yarn | Bulked Yarn |
|---|---|---|
| Breaking Strength (gpd) | 2.8 | 1.5 – 2.2 |
| Breaking Elongation (%) | 30 | 50 – 100 |
| Denier | 70 | 100 – 130 |
| Yarn Specific Volume* | 0.6 | 3.2 – 4.1 |

TABLE III-continued

| Properties of Bulked and Feed Yarns | Feed Yarn | Bulked Yarn |
|---|---|---|
| Dye Rate** | 8 | 18 – 20 |

* Yarn wound under 1-g. tension on a spool with a slot of known volume. The weight of yarn required to fill this slot is used to calculate bulk specific volume.
**Yarn is dyed with Latyl Blue 5G dye and per cent of dye on yarn at 15, 30 and 45 min. calculated from dye concentrations of samples of dye solutions drawn off at these times. Dye rate is given by the average of the following factors for the three time intervals:

$$\frac{\text{Dye on Fiber} \times 100}{\sqrt{\text{Time}}}$$

EXAMPLE VI

In a process similar to Example I, a jet as disclosed in FIG. 1 of Hallden and Murenbeeld U.S. Pat. No. 3,005,251, issued Oct. 24, 1961, is used to impinge yarn on a slotted stainless steel drum (1′ diameter). The surface speed of the drum is 40 ypm. Two-yarn feed speed systems are used to meter a core yarn and an effect yarn to the bulking jet. The core yarn is 210-denier, 102-filament poly(hexamethylene adipamide) and is fed to the jet at 200 ypm. The effect yarn is 1800-denier, 96-filament cellulose acetate at a feed rate of 700 ypm. Steam temperature is 380°F. at 70 psig. The resultant core yarn is stable because of the nylon core and bulky because of the acetate effect yarn. This yarn has the characteristics and utility of a chenille yarn.

Interesting variations can be obtained by using the techniques disclosed in U.S. Pat. No. 2,869,967, whereby some filaments can be broken or staple yarns can be processed to give different visual and tactile properties.

EXAMPLE VII

One end of 1080-denier, 68-filament yarn of poly(hexamethylene adipamide) is prebulked by the method of Example I. This yarn is combined with two ends of 1000-denier, 70-filament yarn of polypropylene as they are introduced into a jet and bulked by the method of Example I. The process uses saturated steam at 307°F., 60 psig., and the yarn feed speed is 140 ypm. The blended yarns are impinged on a 30-mesh, stainless steel screen with a surface speed of 70 ypm.

The yarns are blended and all of the component filaments exhibit the typical random twist and curvilinear crimp.

EXAMPLE VIII

A sheath core yarn prepared by the process of Example I of U.S. Pat. No. 2,931,091, to A. L. Breen is crimped under the processing conditions described in Example IB of Table I. The differential shrinkage conditions of the two-component eccentric sheath core filaments accentuate the crimping effect of the subject process and result in an unusually high bulk, with the filaments crimped in the characteristic three-dimensional nonhelical random curvilinear configuration. The bulk is appreciably greater than would be obtained using normal fibers wherein the filaments are of a single polymeric component.

The following examples illustrate effects which can be obtained by feeding two yarns of different material at the same speed through a bulking jet and delivering the material to the surface of the screen drum. The equipment is as shown in FIG. 2 except that previously drawn yarns are taken directly off packages and are combined through a single yarn guide ahead of draw roll 56, which may be heated to preheat the yarn before entering jet 59. Jet 59 is disclosed in FIG. 1 of Hallden and Murenbeeld U.S. Pat. No. 3,005,251 in which the minimum diameter of the yarn introducing passage 11 is 0.042 inch. (Reference numbers describing the jet are found in U.S. Pat. No. 3,005,251). The fluid injection passage 13 is 0.065 inch diameter. The bulking fluid is steam, the temperature and pressure of which are measured at manifold 12. Angle $\beta$ is 60° and the distance between the center lines of passages 13 and 11 is 0.075 inch where they intersect the surface of housing section 6. In upper housing section 7, angle $\alpha$ is 90°. The maximum diameter of chamber 15 where it abutts housing section 6 is 0.50 inch and the minimum diameter of venturi throat 16 is 0.055 inch, increasing to 0.093 inch at the exit. The overall length of venturi 16 from chamber 15 to the exit is 0.50 inch.

There is no preheating section 10 and no passageway 14.

The screen drum 60 is 40 × 40 mesh having 0.009 inch diameter wires. The gap between jet 59 and the screen is 0.040 inches. The yarns are wound on package 65 at a speed which is selected to give a tension measured after rolls 62 and 63 of 10 grams.

EXAMPLE IX

One end of 70 denier 34 filament type 288 Du Pont nylon and one end of 70 denier 34 filament type 56 Du Pont Dacron polyester yarn were taken from supply packages and combined through a guide ahead of draw roll 55. Processing conditions are shown in Table 4. The bulked yarns were knit into tubing on a Lawson Fiber Analysis Knitter and then were tumbled in hot air at 220°F. to develop bulk. They were then dyed with a mixture of dyes consisting of Pontacyl Fast Blue 5R and Latyl Red B. The red dyed the polyester only and the blue dyed the nylon only. The fabrics were examined for appearance and tactile aesthetics and yarns extracted from the knit tubings were examined at magnification to determine their character. A portion of the combined yarn was cut to a standard length and then filaments of both the nylon and Dacron were extracted from the bundle and measured under tension to determine their extended lengths. It was found that the nylon filaments were 32% longer than the Dacron filaments. Both the nylon and Dacron filaments exhibited typical random curvilinear crimp when relaxed. The nylon migrated preferentially toward the inside of the tubing during knitting because the shorter filaments bore the majority of the tension while going through the needles and held the shorter yarn tight against the needles, allowing the longer filaments to migrate preferentially toward the opposite side. Both the outside and the inside of the tubing exhibited a coarse "heather" appearance due to substantial distances along the length of the combined yarn where the nylon is not intermingled with the Dacron. The outside was predominantly red and the inside was predominantly blued. The inside of the tubing felt bulkier than the outside due to the greater length of the nylon filaments on the inside of the tubing, although the outside predominantly polyester surface had a bulky feel as well.

EXAMPLE X

The same nylon and polyester yarns were fed through the bulking equipment as in Example IX under the conditions shown in Table 4. The chief differences were a lower speed on the draw roll 55 and a high temperature of the roll to preheat the yarns. Under these conditions the difference in length in the extended filaments of nylon and Dacron was 14%. There was a substantial amount of blending between the nylon and Dacron, but the bundle could still be observed as having a predominantly red and predominantly blue portion.

EXAMPLE XI

One end of the same nylon as used in Examples IX and X was combined with one end of 70 denier 30 filament Enka rayon having 4 turns S twist. Process conditions are shown in Table 4. After dyeing and finishing the rayon filaments were undyed and were 2% longer than the nylon. The nylon filaments had random curvilinear crimp but the rayon filaments had little or no crimp. There is essentially no blending between the nylon and rayon, primarily due to the twist in the rayon yarn and the nylon and rayon could be easily separated from each other. The rayon migrated primarily to the inside of the tubing. Both sides exhibited a random "heather" effect, the outside exhibiting the bulky aesthetics of the nylon while the inside had primarily the characteristics of the rayon. The rayon exhibited a slightly slubby appearance.

EXAMPLE XII

One end of the same nylon used in Example IX was combined with one end of 70 denier 24 filament or 40 Du Pont cellulose acetate yarn having a light degree of interlace. After dyeing and finishing the acetate filaments were 6% longer than the nylon. Both the nylon and the acetate filaments exhibited random curvilinear crimp, the degree of crimp in the acetate being less than the crimp in the nylon. Both sides of the fabric exhibited a random heather appearance, the outside having primarily the aesthetics of the nylon and the inside having the aesthetics of the acetate. The acetate was dyed a medium pink. There was less blending between the nylon and acetate than between the nylon and polyester of Examples IX and X, but more blending than exhibited in the yarns of Example XI. The tactility of the crimped acetate was very attractive.

TABLE IV

| | Jet 59 | | Draw Roll 55 | | Screen Drum 60 | Take-off Rolls 62/63 |
|---|---|---|---|---|---|---|
| Example | Temp. °C. | Pressure Psig | Speed YPM | Temp. °C. | Speed YPM | Speed YPM |
| IX | 305 | 49 | 900 | Room | 120 | 513 |
| X | 270 | 50 | 783 | 260 | 100 | 507 |
| XI | 280 | 50 | 667 | 240 | 100 | 507 |
| XII | 291 | 47 | 683 | Room | 100 | 507 |

We claim:

1. A thermoplastic synthetic linear polymer yarn composed of substantially continuous, individually crimped filaments having a random, three-dimensional, curvilinear, extensible configuration continuously along the filament length and having an asymmetric composition across the filament width.

2. A yarn as defined in claim 1 wherein said filaments are two-component eccentric sheath core filaments.

* * * * *